US005246108A

United States Patent [19]

Nusbaum

[11] Patent Number: 5,246,108

[45] Date of Patent: Sep. 21, 1993

[54] GOLF CLUB COVER SUPPORT

[76] Inventor: Robert O. Nusbaum, 56641 Brightwood Blvd., Elkhart, Ind. 46516

[21] Appl. No.: 891,205

[22] Filed: Jun. 1, 1992

[51] Int. Cl.[5] ..... B65D 85/08

[52] U.S. Cl. ..... 206/315.2; 206/315.4; 150/160; 248/225.31

[58] Field of Search ..... 248/225.31, 309.2; 206/315.4, 315.3, 315.2; 150/159, 160

[56] References Cited

U.S. PATENT DOCUMENTS

| | | | |
|---|---|---|---|
| 1,866,665 | 7/1932 | Olin | 248/225.31 |
| 2,014,589 | 9/1935 | Saad | 206/315.4 |
| 2,471,169 | 5/1949 | Salzberg et al. | 206/315.4 |
| 2,879,819 | 3/1959 | Turnbull | 206/315.4 |
| 3,536,187 | 10/1970 | Stafford | 206/361 |
| 3,667,078 | 6/1972 | Distasio | 206/315.4 |
| 4,100,652 | 7/1978 | Carlson | 206/315.3 |
| 4,123,024 | 10/1978 | Levy | 248/225.31 |
| 4,368,768 | 1/1983 | Cunko, Jr. | 150/160 |
| 4,444,371 | 4/1984 | Ragen | 248/225.31 |
| 4,932,523 | 6/1990 | Yamazoe | 206/315.4 |

FOREIGN PATENT DOCUMENTS

| | | | |
|---|---|---|---|
| 2431953 | 1/1976 | Fed. Rep. of Germany | 248/309.2 |
| 150292 | 6/1955 | Sweden | 248/225.31 |
| 206625 | 11/1923 | United Kingdom | 206/315.5 |

*Primary Examiner*—Allan N. Shoap
*Assistant Examiner*—S. Castellano
*Attorney, Agent, or Firm*—Gifford, Groh, Sprinkle, Patmore & Anderson

[57] ABSTRACT

A golf club cover support formed from an elongated member shaped to define the perimeter of a head portion and a shaft portion. The shaft portion including a pair of generally parallel support portions adapted to be disposed at opposite sides of the wall of a golf bag with the support portions spanned by a clamping member permitting the support portions to be pressed towards each other against the walls of the golf bag to support the head portion in a position above the opening of the bag to receive and temporarily support the cover of a golf club.

4 Claims, 1 Drawing Sheet

GOLF CLUB COVER SUPPORT

This invention relates to covers for the heads of golf clubs and more particularly to a support for storing a golf head cover temporarily while the club is being used.

BACKGROUND OF THE INVENTION

Equipment used in playing the game of golf commonly includes covers for certain clubs such as "woods" which can become marred by contact with other clubs in the same bag. To avoid damage to the golf club heads it has been common to use covers fabricated of flexible material such as plastic leather or knitted fabric.

Such golf club covers are removed from the golf club head when the club is to be used and as a result often are misplaced or lost. To avoid loss or misplacement it is common to provide tethers to maintain the cover attached to the bag or to each other. However in such arrangements the tethers often become tangled and are otherwise troublesome to use.

In some prior art arrangements it is common to use Velcro material with complementary portions associated with the bag and with the golf club cover. In such arrangements there is a need to properly align the mating Velcro portions with each other to insure that the cover is attached to the golf bag.

SUMMARY OF THE INVENTION

In accordance with the present invention the problems encountered with other prior art golf club covers are eliminated by providing a support which can be detachably attached to the top edge of an opening in the golf club bag to temporarily support the cover while the club for which the cover is intended is used in play.

More specifically, a golf club cover support is formed of a continuous elongated member which is bent in the shape generally defining the perimeter of the profile of a golf club head and a portion of the adjacent shaft. The portion defining the shaft includes a pair of parallel portions extending from the head defining portion which are adapted to be positioned at opposite sides of the wall of a golf bag. Clamping means are associated with the support members to urge them towards each other and clamp opposite sides of the golf bag wall to position the head portion in an upright position extending above the top edge of the bag and with the head portion extending outwardly beyond the perimeter of the bag to give full access to the opening in the bag for other golf clubs.

In use of the invention, the cover is removed from the club and immediately placed on the support where it remains until the club is returned to the bag at which time the cover is removed from the support and placed on the club. The motion of removing and replacing the cover on the golf club head and on the cover support are the same and occur naturally without any need to search for and align complimentary attaching portions. Moreover, if desired, any covered club can be removed from the bag while it is covered without obstruction of tethers.

The above and other objects and features of the invention will become apparent from the following detailed description taken in connection with the accompanying drawings forming a part of the specification.

DESCRIPTION OF THE PREFERRED EMBODIMENT

The golf club cover support embodying the invention is designated generally at 10 is in the form of a frame shaped from an elongated member 12 bent to define the perimeter of a profile having a loop or head portion 14 merging with a shank portion 16.

Figure 1:
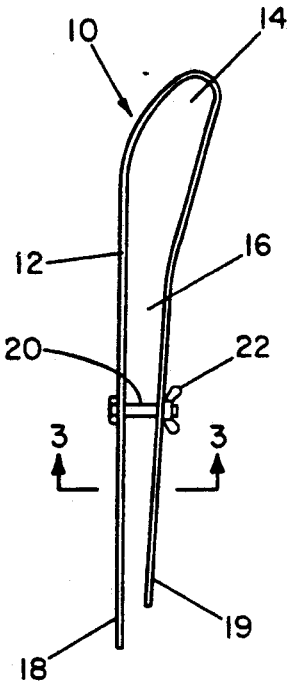
FIG. 1 is a side elevation of the golf club cover support embodying the invention.
Figure 2:
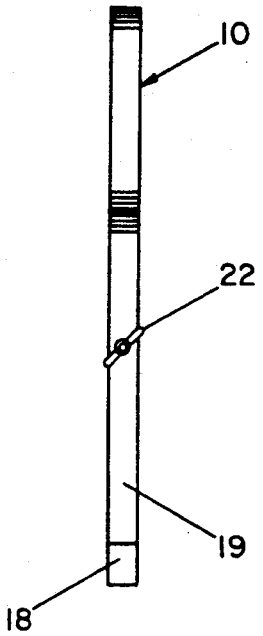
FIG. 2 is an edge view of the golf club cover support seen in FIG. 1.
Figure 3:
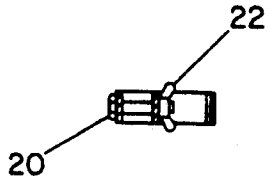
FIG. 3 is a cross-sectional view taken on line 3—3 in FIG. 1.

The ends of the elongated member 12 forming the shank portion 16 extend substantially parallel to each other and the head portion 14 extends to one side of the shank portion 16 with all of the elongated member forming the head portion and shank portion lying in a common plane. Preferably, the elongated member 12 is in the form of metal bar stock having a generally rectangular cross-section as shown in FIG. 3.

The ends of the elongated member 12 form support portions 18 and 19 which are generally parallel to each other. The support portions 18 and 19 are spanned by means in the form of a threaded member or bolt 20 and a wing nut 22 which can be rotated relative to the threaded member 20 to urge the support portions 18 and 19 toward each other. The limited movement of the support portions is permitted by the flexibility of the loop forming the head portion 14.

The golf club cover support is an accessory which may be detachably attached to the open end of a conventional golf bag 24. This is accomplished by disposing the support member 10 on the open end of a golf bag with the support portion 18 inside the bag and the support portion 19 outside the bag so that the support portions 18, 19 are in opposed relationship to each other at opposite sides of the wall 26 of the golf bag 24. The threaded member 20 forms a stop to limit downward movement of the support 10 and upon tightening of the wing nut 22 the loop 14 offers sufficient flexibility so that the support portions 18 and 19 are urged towards each other to clamp the structure to the wall 26 of bag 24.

Figure 4:
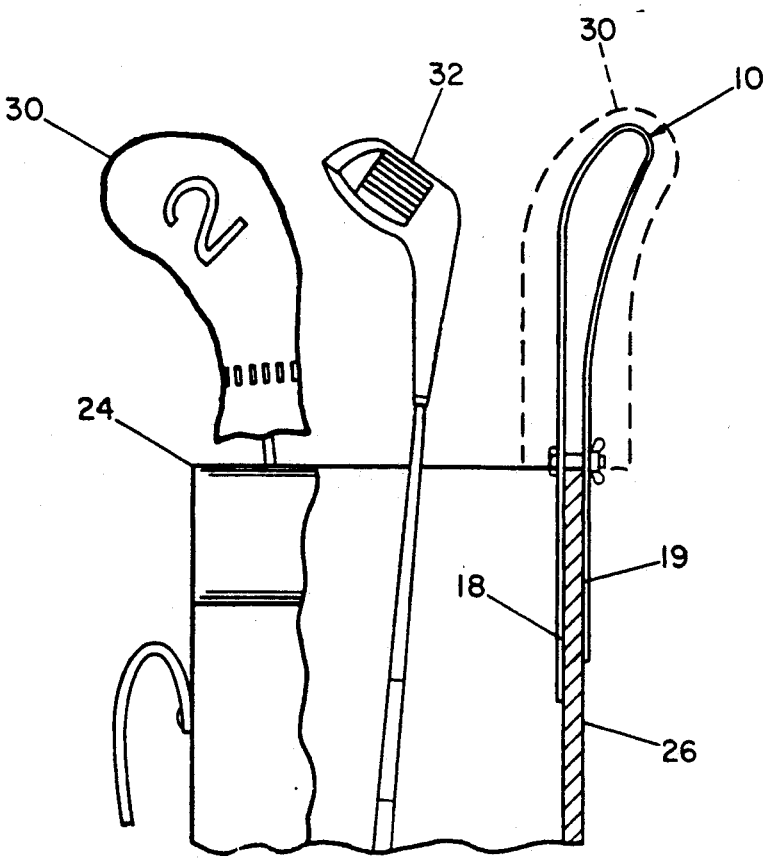
FIG. 4 is a view of the golf club cover support attached to a golf bag showing the golf bag broken away and portions in cross-section.

In the mounted position, the loop or head portion 14 extends outwardly of the opening to the golf bag in readiness to receive a golf club cover 30 which in FIG. 4 is illustrated by a broken line.

In use, a cover such as the cover 30 can be removed from a club head indicated at 32 and placed on the head portion 14 of the support 10 in the position indicated in broken line in FIG. 4. Thereafter the club 32 can be removed from the bag and put into use. When the club 32 is returned to the bag, the cover 30 can be removed from the support 10 and replaced on the club 32. The motion in placing a golf club cover 30 on the support 10 and removing it from the support is the same as the motion used in covering and uncovering a golf club head.

It will be understood that if desired a selected club with its cover can be removed from the bag independently of any of the other covered clubs and the support 10. It should be noted also, that the head portion 14 of the support 10 extends outwardly from the golf bag 14 in a position which does not interfere with the loading and unloading of the golf bag 24 or with the other clubs already stored in the bag.

At the end of play, the support 10 can easily be removed from its clamped position on the wall 26 of the bag 10 by loosening the wing nut 22 after which the support 10 may be removed from the bag and stored within the bag or in one of the usual pockets associated with a bag.

A golf club cover support has been provided which may be detachably attached to a golf bag in position to receive a golf club cover in the same manner as the covers is applied to a golf club and to permit storage of the cover until the club is returned to the bag in readiness to receive its cover after it is removed from the support where it has been temporarily stored.

I claim:

1. A golf club cover support for attachment to a golf bag to temporarily store a golf club head cover when a club is uncovered and removed from the golf bag for use, said golf club cover support comprising;

a frame structure including a continuous, elongated member defining a profile of a golf club head portion and having a pair of parallel support members extending from said head portion and adapted to be positioned adjacent a top opening and at opposite sides of a wall of said golf bag, and clamping means detachably securing said frame structure to said golf bag, said clamping means extending between said support members for engagement with a top of said golf bag at said top opening to limit the downward position of said frame structure relative to said golf bag and to urge said support members toward each other to engage said wall and hold said frame in a fixed, selected position on said golf bag with said head portion extending above and outwardly of said top opening in said golf bag to receive and support said golf club head cover when the latter is removed from said club.

2. The golf club cover support of claim 1 wherein said elongated member has a generally rectangular cross-section.

3. The golf club cover support of claim 1 wherein said clamping means is a threaded member extending between said support members.

4. The golf club cover support of claim 1 wherein said continuous, elongated member is disposed in substantially a common plane.

* * * * *